US010920650B2

(12) United States Patent
Ichikawa et al.

(10) Patent No.: US 10,920,650 B2
(45) Date of Patent: Feb. 16, 2021

(54) VERTICAL MULTICYLINDER STRAIGHT ENGINE

(71) Applicant: KUBOTA Corporation, Osaka (JP)

(72) Inventors: Takayuki Ichikawa, Sakai (JP); Mutsuhisa Ishihara, Sakai (JP); Shinya Asada, Sakai (JP); Yasushi Kobayashi, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 267 days.

(21) Appl. No.: 15/972,329

(22) Filed: May 7, 2018

(65) Prior Publication Data

US 2019/0003368 A1 Jan. 3, 2019

(30) Foreign Application Priority Data

Jun. 30, 2017 (JP) ..... 2017-129912

(51) Int. Cl.
*F01P 3/02* (2006.01)
*F02F 1/14* (2006.01)
(Continued)

(52) U.S. Cl.
CPC ..... *F01P 3/02* (2013.01); *F01P 3/08* (2013.01); *F02F 1/14* (2013.01); *F02F 7/0007* (2013.01);
(Continued)

(58) Field of Classification Search
CPC ..... F01P 3/02; F01P 3/08; F02F 1/14; F02F 7/0007
See application file for complete search history.

(56) References Cited

U.S. PATENT DOCUMENTS 2,089,454 A * 8/1937 Walden ..... F02F 1/108 123/41.44
4,665,867 A * 5/1987 Iwamoto ..... F01P 3/02 123/41.28
(Continued)

FOREIGN PATENT DOCUMENTS

EP 0965743 A2 12/1999
JP S5676109 U 6/1981
(Continued)

OTHER PUBLICATIONS

Extended European Search Report dated Jun. 29, 2018 in EP Application No. 18166667.8.
(Continued)

*Primary Examiner* — Kevin A Lathers
(74) *Attorney, Agent, or Firm* — Panitch Schwarze Belisario & Nadel LLP

(57) ABSTRACT

There is provided a vertical multicylinder straight engine in which the temperature distribution of a plurality of cylinder barrels is made close to an even state. A cylinder jacket includes: a jacket inlet; a separated channel; a plurality of separated outlets; and heat dissipater channels for dissipating heat of the respective cylinder barrels to engine cooling water introduced through the separated outlets. The plurality of separated outlets include: a front-side separated outlet to a front-end barrel; a rear-side separated outlet to a rear-end barrel; and middle separated outlets to middle barrels between the front-end barrel and the rear-end barrel, and the jacket inlet is disposed so as to be contained within an entire middle barrel side area that is lateral to the middle barrels and has a front-rear length as long as a length from a front-most end to a rear-most end of the middle barrels.

20 Claims, 10 Drawing Sheets

(51) Int. Cl.

| | |
|---|---|
| ***F01P 3/08*** | (2006.01) |
| ***F02F 7/00*** | (2006.01) |
| ***F02F 1/10*** | (2006.01) |
| ***F01P 3/00*** | (2006.01) |

(52) U.S. Cl.
CPC ... *F01P 2003/008* (2013.01); *F01P 2003/021* (2013.01); *F02F 2001/106* (2013.01)

(56) References Cited

U.S. PATENT DOCUMENTS

| | | | | |
|---|---|---|---|---|
| 6,962,131 | B2 * | 11/2005 | Aketa | F01P 3/02 123/41.01 |
| 7,021,250 | B2 * | 4/2006 | Marinica | F01P 3/02 123/41.72 |
| 7,044,088 | B2 * | 5/2006 | Aketa | F01M 11/03 123/41.18 |
| 2004/0079300 | A1 * | 4/2004 | Kim | F02F 1/38 123/41.74 |
| 2017/0159601 | A1 * | 6/2017 | Park | F02F 1/14 |

FOREIGN PATENT DOCUMENTS

| | | | |
|---|---|---|---|
| JP | S57081434 | U | 5/1982 |
| JP | S57174716 | U | 11/1982 |
| JP | S59085349 | U | 6/1984 |
| JP | S60190646 | A | 9/1985 |
| JP | H05066219 | A | 3/1993 |
| JP | H09096244 | A | 4/1997 |
| JP | H11280538 | A | 10/1999 |
| JP | 2000064903 | A | 3/2000 |
| JP | 2002070640 | A | 3/2002 |
| JP | 2006090171 | A | 4/2006 |
| JP | 2008095645 | A | 4/2008 |
| JP | 2011106400 | A | 6/2011 |
| JP | 2016056770 | A | 4/2016 |
| JP | 2016056771 | A | 4/2016 |
| WO | 9103632 | A1 | 3/1991 |

OTHER PUBLICATIONS

Office Action dated May 14, 2020 in Japanese Application No. 2017-139912.

Office Action dated Jun. 2, 2020 in Japanese Application No. 2018-170227.

Office Action dated Jun. 2, 2020 in Japanese Application No. 2018-170228.

* cited by examiner

VERTICAL MULTICYLINDER STRAIGHT ENGINE

CROSS-REFERENCE TO RELATED APPLICATION

This application claims priority under 35 U.S.C. § 119(b) to Japanese Patent Application No. 2017-129912, filed Jun. 30, 2017, the disclosure of which is incorporated herein by reference in its entirety.

BACKGROUND OF THE INVENTION

(1) Field of the Invention

The present invention relates to a vertical multicylinder straight engine.

(2) Description of Related Art

With a conventional engine, over cooling at a front-end cylinder barrel and insufficient cooling at a rear-end cylinder barrel occur easily, and the temperature distribution of a plurality of cylinder barrels sometimes becomes an uneven state.

SUMMARY OF THE INVENTION

An object of the present invention is to provide a vertical multicylinder straight engine in which the temperature distribution of a plurality of cylinder barrels is made close to an even state.

The present invention includes a cylinder block around a plurality of cylinder barrels, the cylinder block allowing engine cooling water to pass through a cylinder jacket.

The cylinder jacket includes: a jacket inlet for introducing engine cooling water supplied from a radiator; and a plurality of separated outlets for diverting the engine cooling water toward the respective cylinder barrels.

The jacket inlet is disposed so as to be contained within an entire middle barrel side area that is lateral to middle barrels and has a front-rear length as long as a length from a front-most end to a rear-most end of the middle barrels.

It is desirable that the engine is a four-cylinder engine, and that the jacket inlet is disposed on a backward side of the entire middle barrel side area, a front-side separated outlet is disposed on a backward side of a front-end barrel side area, a rear-side separated outlet is disposed on a forward side of a rear-end barrel side area, and a pair of middle separated outlets are respectively disposed on a backward side of a pair of middle barrel side areas.

According to the present invention, the temperature distribution of the plurality of cylinder barrels is made close to an even state.

DETAILED DESCRIPTION OF PREFERRED EMBODIMENTS

FIGS. 1 through 10 are views illustrating a water-cooling engine according to an embodiment of the present invention, and a water-cooling common-rail straight four-cylinder diesel engine is described in this embodiment.

The following is an outline of this engine.

Figure 6:
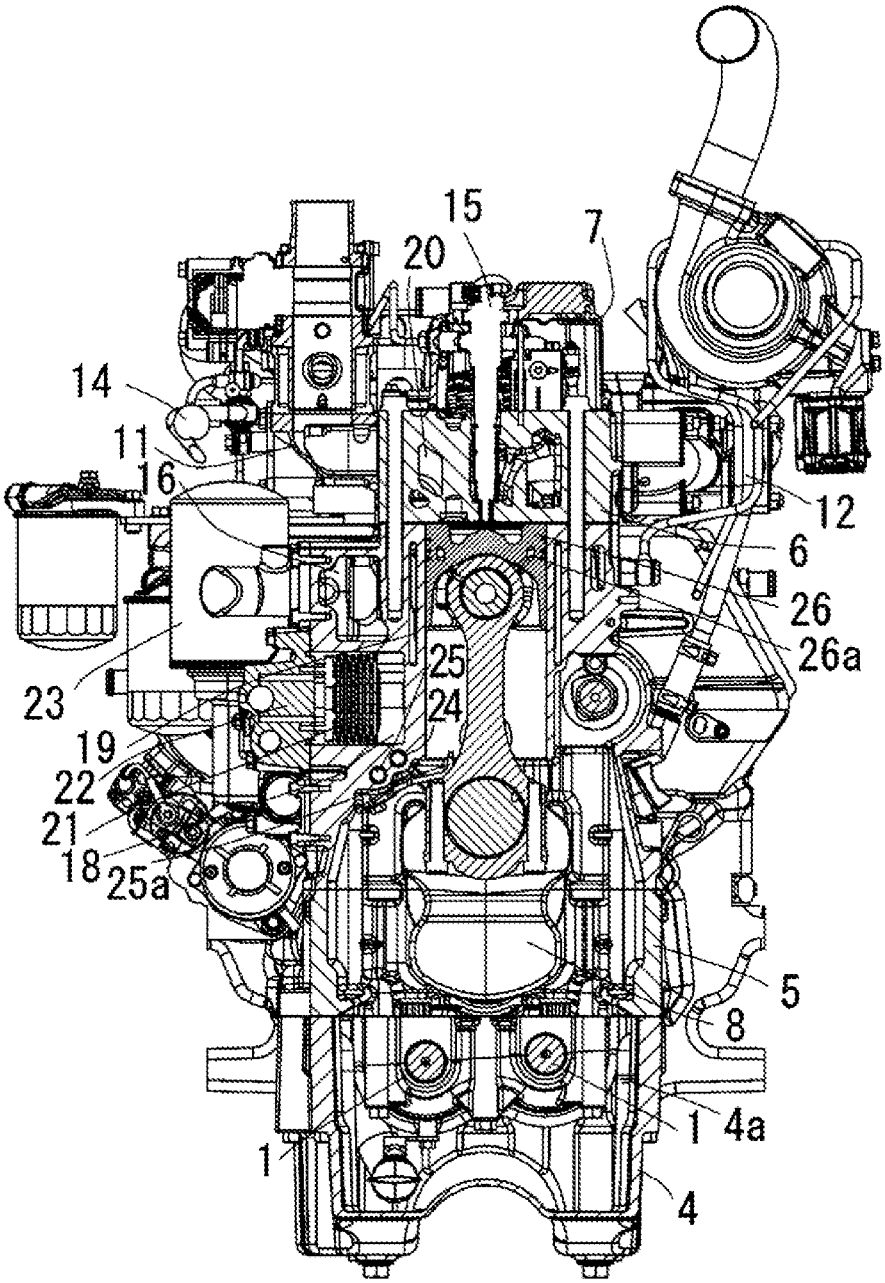
FIG. 6 is a longitudinal sectional front view of the engine according to the embodiment of the present invention.
Figure 7:
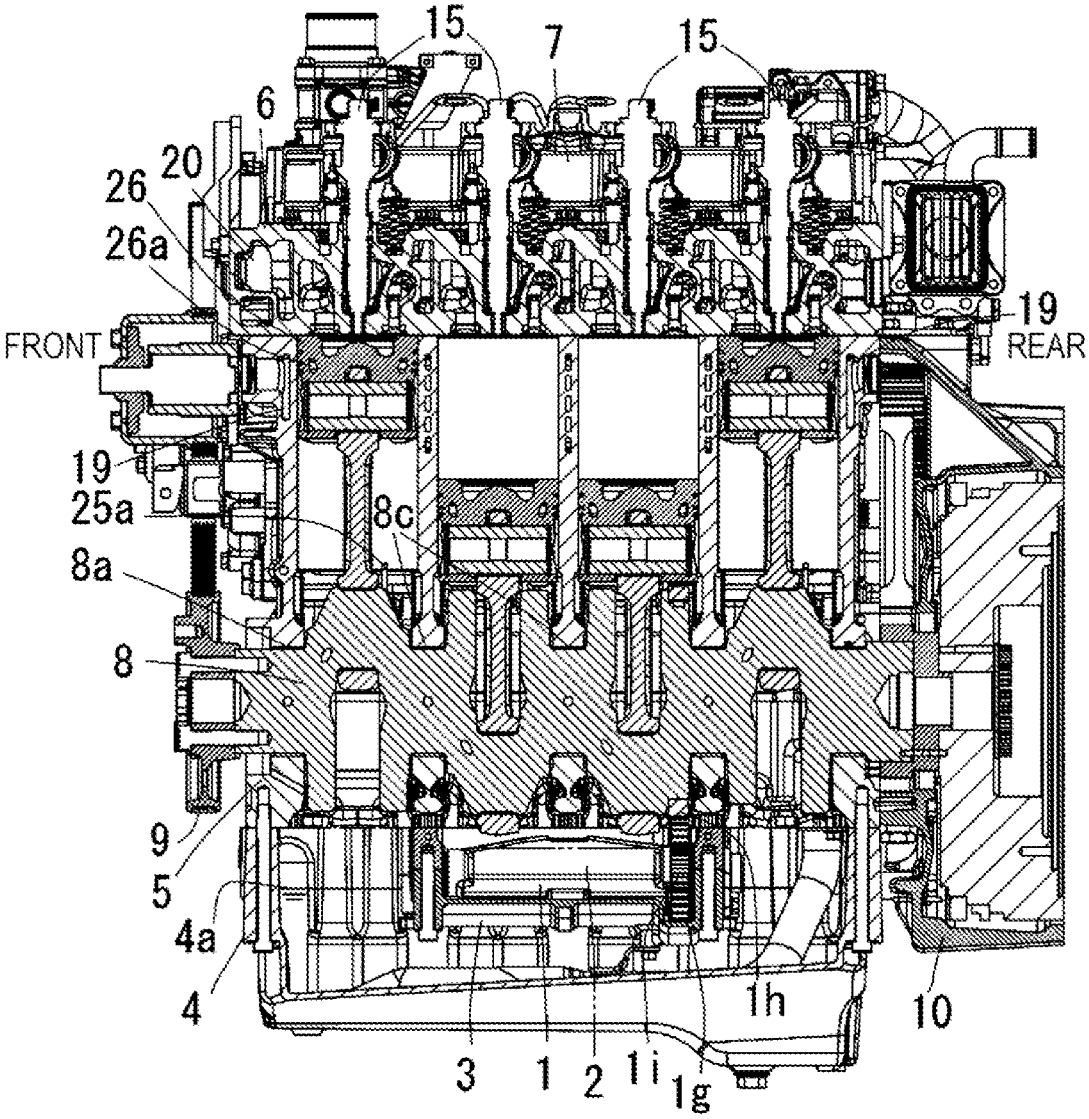
FIG. 7 is a longitudinal sectional side view of the engine of FIG. 6.
Figure 8:
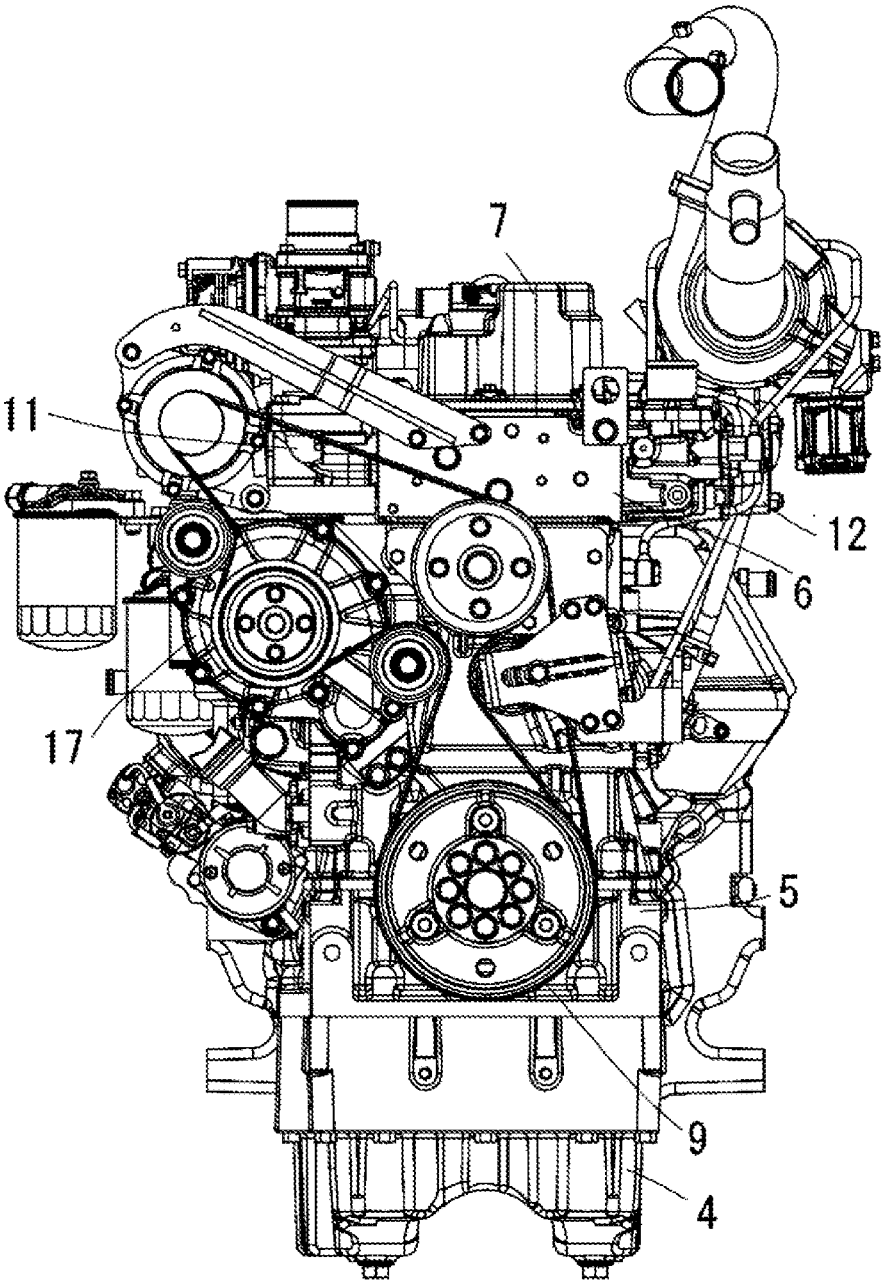
FIG. 8 is a front view of the engine of FIG. 6.

As illustrated in FIG. 6, the engine includes: a cylinder block (5); a cylinder head (6) disposed above the cylinder block (5); a cylinder head cover (7) disposed above the cylinder head (6); an oil pan (4) disposed under the cylinder block (5); a belt transmission mechanism (9) disposed on a front side of the cylinder block (5), as illustrated in FIG. 7, taking a direction along which a crankshaft (8) is installed as a front-rear direction; a flywheel housing (10) disposed on a rear side of the cylinder block (5); an intake manifold (11) disposed on one lateral side of the cylinder head (6), as illustrated in FIG. 6, taking a direction of the width of the engine intersecting orthogonally to front-rear direction as a lateral direction; and an exhaust manifold (12) disposed on the other lateral side of the cylinder head (6).

The engine also includes a fuel injection device, an antivibration device, a water-cooling device, a lubricating device, and an oil-cooling device.

Figure 9:
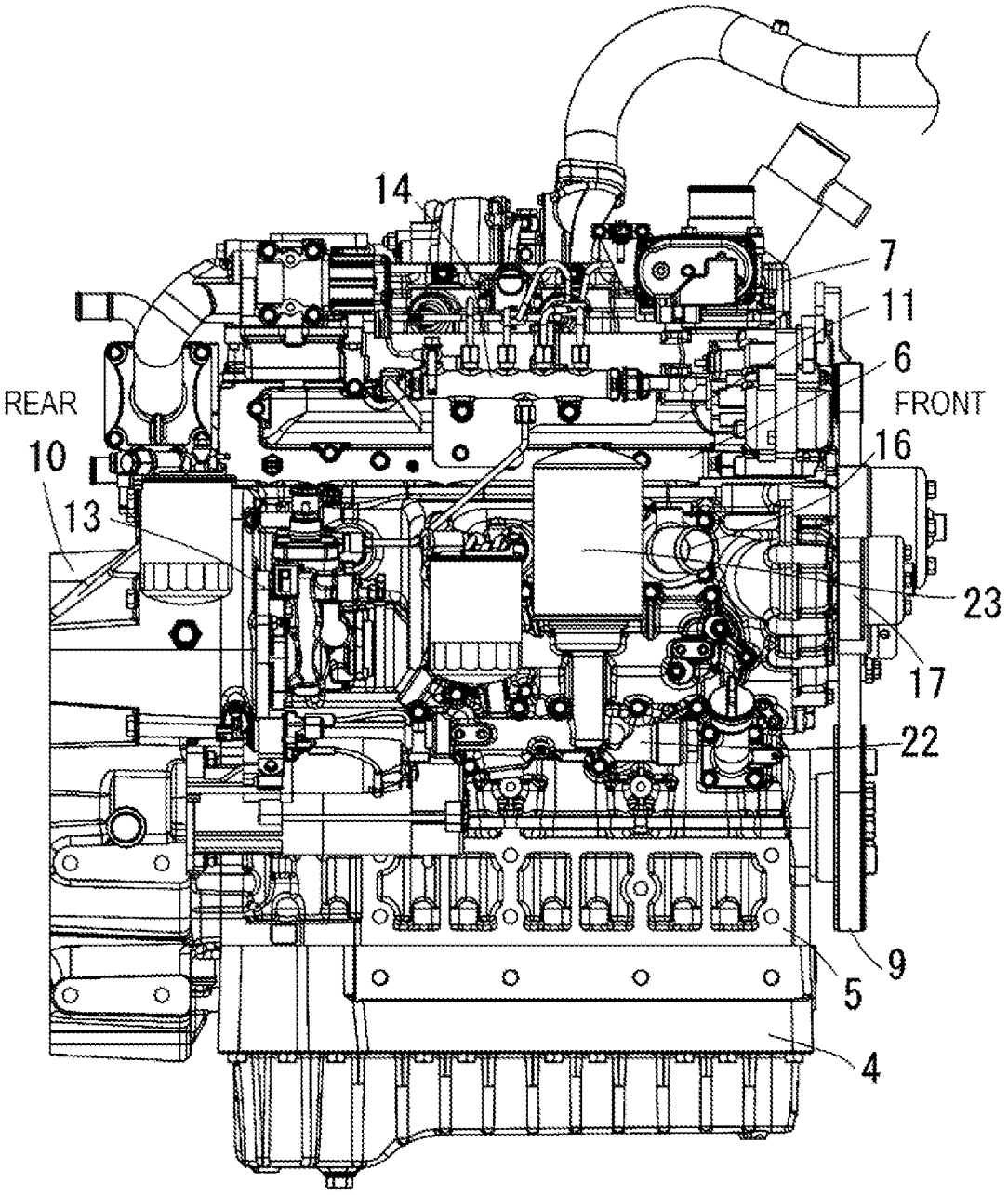
FIG. 9 is a side view of the engine of FIG. 6.
Figure 10:
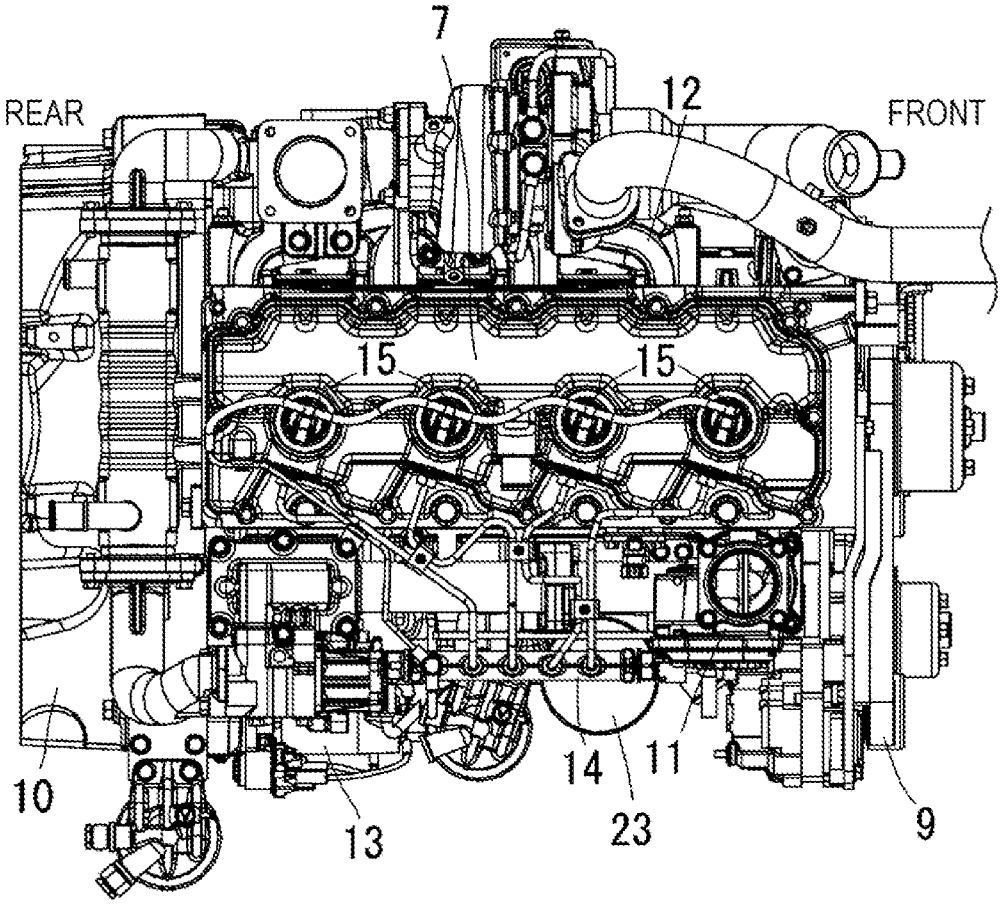
FIG. 10 is a plan view of the engine of FIG. 6.

The fuel injection device is of a common-rail type, including a fuel supply pump (13) and a common rail (14) as illustrated in FIG. 9, as well as a fuel injector (15) as illustrated in FIG. 7, and injects fuel into a combustion chamber.

As illustrated in FIG. 6, the antivibration device includes a rotating balancer (1), and cancels secondary oscillation of the engine, and reduces oscillation of the engine.

The water-cooling device includes: a radiator (not shown); a water inlet chamber (16) disposed on an intake side of the cylinder block (5), as illustrated in FIG. 6; a water pump (17) disposed on a front side of the water inlet chamber (16), as illustrated in FIG. 9; an intermediary water channel (18) disposed behind the water pump (17) and under the water inlet chamber (16), as illustrated in FIG. 6; a block-side water jacket (19) disposed within the cylinder block (5); and a head-side water jacket (20) disposed within the cylinder head (6).

The water-cooling device circulates engine cooling water after heat is dissipated therefrom by the radiator, at a pumping pressure of the water pump (17), through the water inlet chamber (16), the water pump (17), the intermediary water channel (18), the block-side water jacket (19), the head-side water jacket (20), and the radiator, in the stated order, to water-cool the engine.

The lubricating device includes: an oil pump (not shown) disposed within a rear section of the cylinder block (5); an oil cooler (21) contained within the intermediary water channel (18) as illustrated in FIG. 6; an oil filter (23) attached, along with the oil cooler (21), to a supplementary-unit attachment base (22); and an oil gallery (24) disposed within a solid wall of the cylinder block (5) on an intake side. The lubricating device circulates engine oil (4*a*) within the oil pan (4) at a pumping pressure of the oil pump, through the oil pump, the oil cooler (21), the oil filter (23), the oil gallery (24), an engine sliding unit such as a bearing (8*a*) of the crankshaft (8) illustrated in FIG. 3, and the oil pan (4), in the stated order, to forcibly lubricate the sliding unit of the engine.

As illustrated in FIG. 6, the oil-cooling device includes: oil delivery channels (25) disposed within the solid wall of the cylinder block (5) on the intake side in parallel with the oil gallery (24); an oil jet nozzle (25*a*) disposed under a piston (26); and a cooling channel (26*a*) disposed within the piston (26). The oil-cooling device causes a part of the engine oil (4*a*) that has passed through the oil cooler (21) and the oil filter (23) of the lubricating device in turn to be diverted to the oil delivery channels (25) in the supplementary-unit attachment base (22), and to be injected to the cooling channel (26*a*) through oil jet nozzle (25*a*), to oil cool the piston (26).

Figure 1:
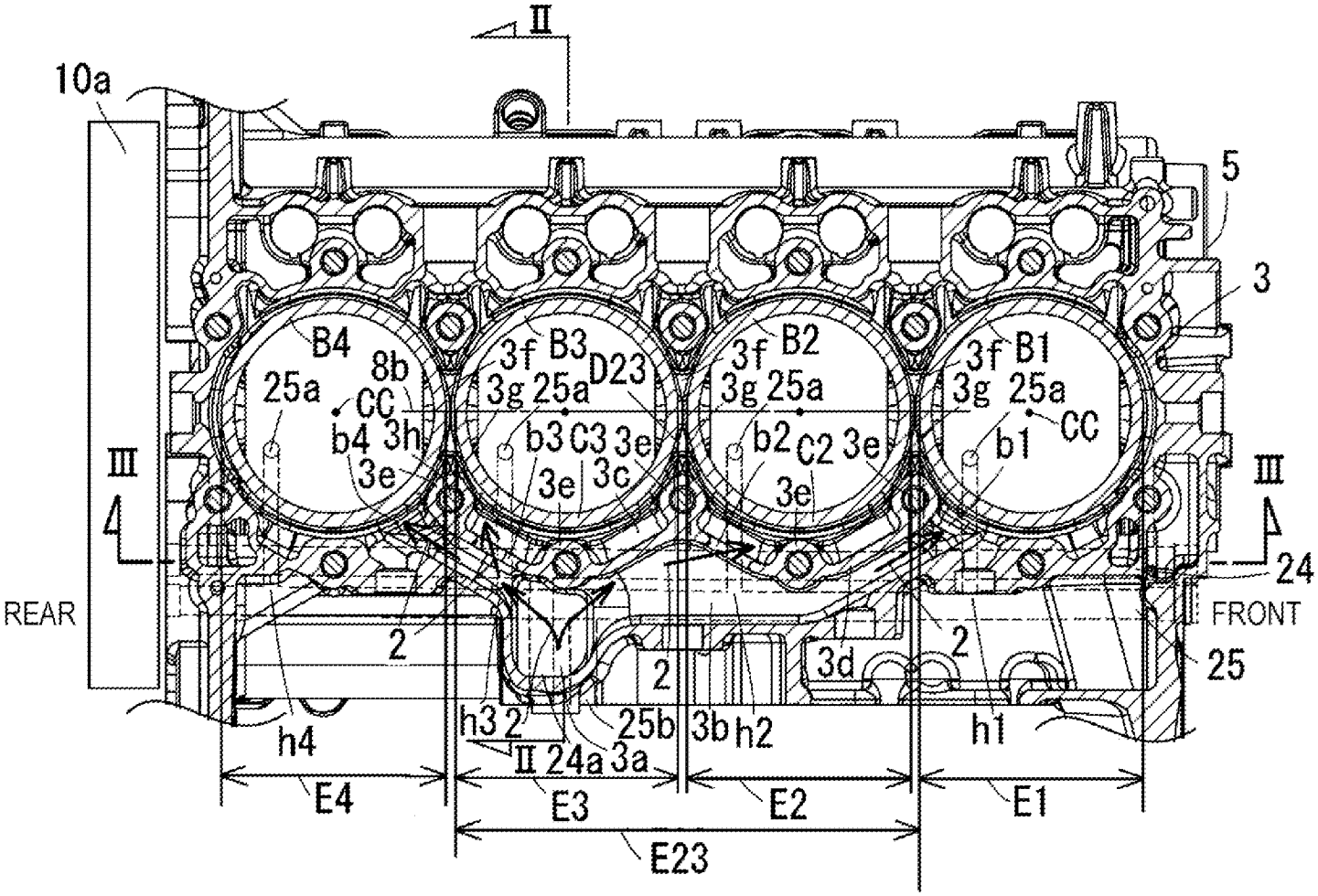
FIG. 1 is a transverse sectional plan view of a cylinder block of an engine according to an embodiment of the present invention.

As illustrated in FIG. 1, the engine includes the cylinder block (5), around a plurality of cylinder barrels, for allowing engine cooling water (2) to pass through a cylinder jacket (3).

A configuration of the cylinder block (5) is as follows.

The plurality of cylinder barrels include a front-end barrel (B1), a rear-end barrel (B4), and middle barrels (B2) and (B3) disposed between these two barrels, taking a direction along which a crankshaft central axis line (8*b*) extends as a front-rear direction, and a side of a flywheel (10*a*) as a rear side.

The cylinder jacket (3) includes: a jacket inlet (3*a*) for introducing the engine cooling water (2) supplied from the radiator; separated channels (3*b*) for diverting the engine cooling water (2) introduced through the jacket inlet (3*a*) in the front-rear direction; a plurality of separated outlets for diverting the engine cooling water (2) diverted in the front-rear direction toward the respective cylinder barrels; and heat dissipater channels (3*c*) for dissipating heat of the respective cylinder barrels to the engine cooling water (2) introduced through the separated outlets.

The plurality of separated outlets include: a front-side separated outlet (b1) to the front-end barrel (B1); a rear-side separated outlet (b4) to the rear-end barrel (B4); and middle separated outlets (b2) and (b3) to the middle barrels (B2) and (B3) between the front-end barrel (B1) and the rear-end barrel (B4).

The jacket inlet (3*a*a) is disposed so as to be contained within an entire middle barrel side area (E23) that is lateral to the middle barrels (B2) and (B3) and has a front-rear length as long as a length from a front-most end to a rear-most end of the middle barrels (B2) and (B3).

Specifically, the jacket inlet (3*a*) is disposed so as not to extend on the front side or the rear side beyond the entire middle barrel side area (E23).

Therefore, according to this embodiment, the engine cooling water (2) is introduced into the cylinder jacket (3) through the jacket inlet (3*a*) in the entire middle barrel side area (E23), a difference between distances from the respective cylinder barrels to the jacket inlet (3*a*) is reduced, over or insufficient cooling of the cylinder barrels may not easily occur, and the temperature distribution of the plurality of cylinder barrels is made close to an even state.

As illustrated in FIG. 1, the front-side separated outlet (b1) is disposed so as to be contained within a front-end barrel side area (E1) that is lateral to the front-end barrel (B1) and has a front-rear length as long as a length of the front-end barrel (B1), the rear-side separated outlet (b4) is disposed so as to be contained within a rear-end barrel side area (E4) that is lateral to the rear-end barrel (B4) and has a front-rear length as long as a length of the rear-end barrel (B4), and the middle separated outlets (b2) and (b3) are disposed so as to be respectively contained within middle barrel side areas (E2) and (E3) that are lateral to the middle barrels (B2) and (B3) and have front-rear lengths as long as lengths of the middle barrels (B2) and (B3).

Specifically, each of the separated outlets is disposed so as not to extend on the front side or the rear side beyond corresponding one of the barrel side areas.

Therefore, according to this embodiment, relative positions of each of the separated outlets and corresponding one of the cylinder barrels become uniform, and cooling conditions of the cylinder barrels are made close to be even.

As illustrated in FIG. 1, the engine is a four-cylinder engine, and the jacket inlet (3*a*) is disposed on a backward side of the entire middle barrel side area (E23), the front-side separated outlet (b1) is disposed on the backward side of the front-end barrel side area (E1), the rear-side separated outlet (b4) is disposed on the forward side of the rear-end barrel side area (E4), and a pair of the middle separated outlets (b2) and (b3) are respectively disposed on the backward side of a pair of the middle barrel side areas (E2) and (E3).

Therefore, according to this embodiment, the diverted distance to cylinder barrels of two cylinders on the rear side from which heat dissipation is easily hindered by the flywheel (10*a*) is short, and the diverted distance to cylinder barrels of two cylinders on the front side from which heat is easily dissipated is long. Thus, the temperature distribution of the cylinder barrels of four cylinders is made close to the even state.

As illustrated in FIG. 1, the cylinder jacket (3) includes a series of partition walls (3*d*) that divide the separated channels (3*b*) from the heat dissipater channels (3*c*).

The partition walls (3*d*) are bended along concavity and convexity of side-projecting curved sections (C2) and (C3) of a pair of the middle barrels (B2) and (B3) and a side-depression section (D23) between the side-projecting curved sections (C2) and (C3), and the partition walls (3*d*) include screw bosses (3*e*) at both ends and at bended portions, the screw bosses (3*e*) being for screw fitting with head bolts (3*h*) for fastening the cylinder head (6) to the cylinder block (5).

Therefore, according to this embodiment, the screw bosses (3*e*) increase rigidity of the partition walls (3*d*), the partition walls (3*d*) do not easily oscillate, combusting noise and piston slap noise laterally emitted from the cylinder barrels are reflected on the partition walls (3*d*), and engine noise emitted on the lateral side of the cylinder block (5) is reduced.

As illustrated in FIG. 1, the cylinder jacket (3) includes a transverse channel (3*f*), between the cylinder barrels that are adjacent to each other, through which the engine cooling water (2) passes, and the screw bosses (3*e*) are raised from the partition walls (3*d*) toward a channel inlet (3*g*) of the transverse channel (3*f*).

Therefore, according to this embodiment, the engine cooling water (2) flowed into the heat dissipater channel (3*c*) is guided by the screw bosses (3*e*) toward the transverse channel (3*f*), and thus cooling efficiency of the cylinder barrels is increased.

As illustrated in FIG. 1, the screw bosses (3*e*) are raised from the partition walls (3*d*) toward the side-projecting curved sections (C2) and (C3) of the middle barrels (B2) and (B3).

Therefore, according to this embodiment, the engine cooling water (2) flowed into the heat dissipater channel (3*c*) is guided by the screw bosses (3*e*) toward the side-projecting curved sections (C2) and (C3) of the middle barrels (B2) and (B3), and thus cooling efficiency of the middle barrels (B2) and (B3) is increased.

Figure 2:
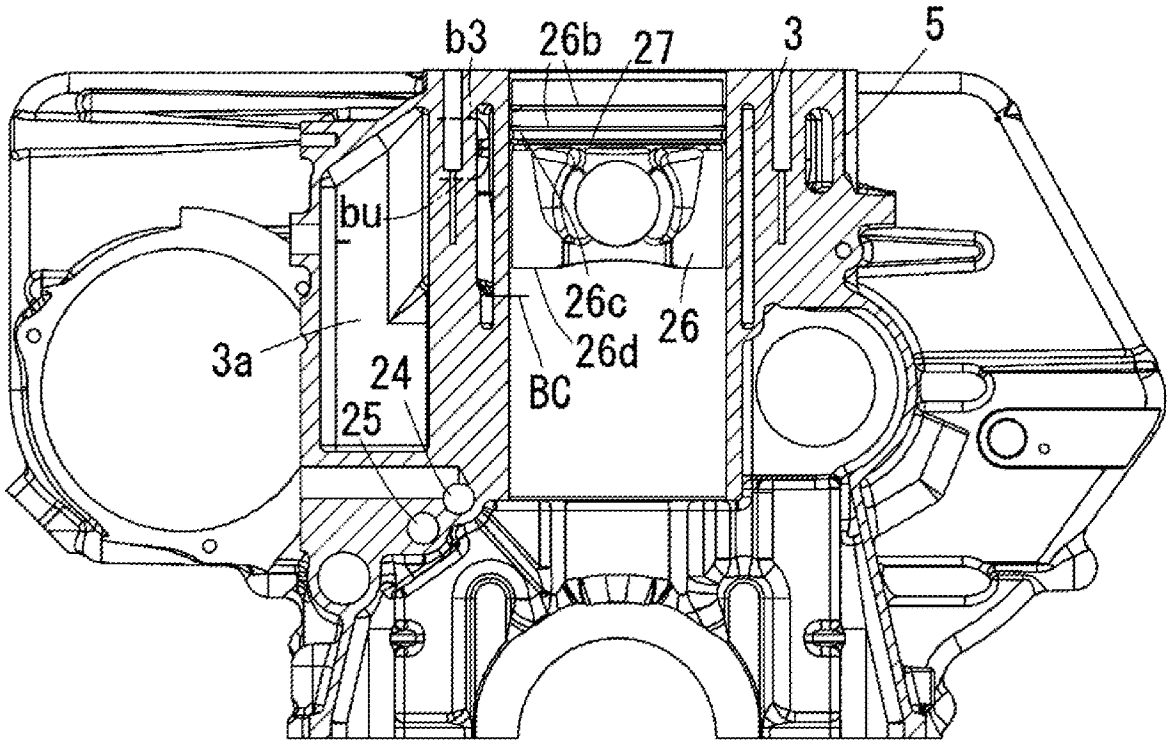
FIG. 2 is a sectional view taken along line II-II in FIG. 1.

As illustrated in FIG. 2, an opening lower edge (bu) of each of the separated outlets is disposed at a position higher than a vertical center (BC) of a cylinder barrel to which the corresponding separated outlet faces.

Therefore, according to this embodiment, the engine cooling water (2) is introduced through the separated outlet to an upper half of the cylinder barrel, insufficient cooling of the upper half of the cylinder barrel and over cooling of a lower half of the cylinder barrel are avoided, and temperature distribution of the cylinder barrels in a vertical direction is made close to an even state.

As illustrated in FIG. 2, the opening lower edge (bu) of each of the separated outlets is disposed at a position lower than a lowermost position (26*c*) of a pressure ring (26*b*) of the piston (26) at a top dead point within the cylinder barrel to which the corresponding separated outlet faces, and at a position higher than a lowermost position (26*d*) of the piston (26).

Therefore, according to this embodiment, it is possible to avoid insufficient cooling of a raised portion of the cylinder barrel that is susceptible to heat from the pressure ring (26*b*), as well as over cooling of a lowered portion of the cylinder barrel from which heat is not easily dissipated by the piston (26), and temperature distribution of the cylinder barrels in a vertical direction is made close to an even state.

There are two pressure rings (26*b*) one above the other, and a lower end of the lower one of the pressure rings (26*b*) forms the lowermost position (26*c*).

An oil ring (27) is disposed under the lower one of the pressure rings (26*b*), and the opening lower edge (bu) of each of the separated outlets is disposed at a position lower than a lower end of the oil ring (27) of the piston (26) at the top dead point within the cylinder barrel to which the separated outlet faces.

As illustrated in FIG. 1, the cylinder block (5) includes: an oil inlet (25*b*) for introducing the engine oil (4*a*) supplied from the oil pump; the oil delivery channels (25) for diverting the engine oil (4*a*) introduced through the oil inlet (25*b*) in the front-rear direction; a plurality of diverting oil outlets for diverting the engine oil (4*a*) that is diverted in the front-rear direction by the oil delivery channels (25) to the oil jet nozzle (25*a*) facing the piston (26).

The oil delivery channels (25) are directed in the front-rear direction, and the plurality of the diverting oil outlets include: a front diverting oil outlet (h1) and a rear diverting oil outlet (h4) that are respectively disposed on the front side and the rear side of the oil delivery channel (25); and intermediate diverting oil outlets (h2) and (h3) that are disposed between the front diverting oil outlet (h1) and the rear diverting oil outlet (h4).

As illustrated in FIG. 1, the oil inlet (25*b*) is disposed at a position overlapping the entire middle barrel side area (E23), when viewed parallelly with the cylinder central axis line (CC).

Specifically, when viewed along a plane parallel with the cylinder central axis line (CC), the oil inlet (25*b*) is disposed in a region overlapping and immediately under the entire middle barrel side area (E23).

Therefore, according to this embodiment, a difference between distances from the oil inlet (25*b*) to the oil diverting points is reduced, over or insufficient cooling of the pistons (26) may not easily occur, and the temperature distribution of the plurality of cylinder barrels is made close to an even state.

When viewed parallelly with the cylinder central axis line (CC), each of the diverting oil outlets is disposed at a position overlapping the corresponding one of the barrel side areas.

Specifically, each of the diverting oil outlets is disposed at a position overlapping and immediately under the corresponding one of the barrel side areas.

Figure 3:
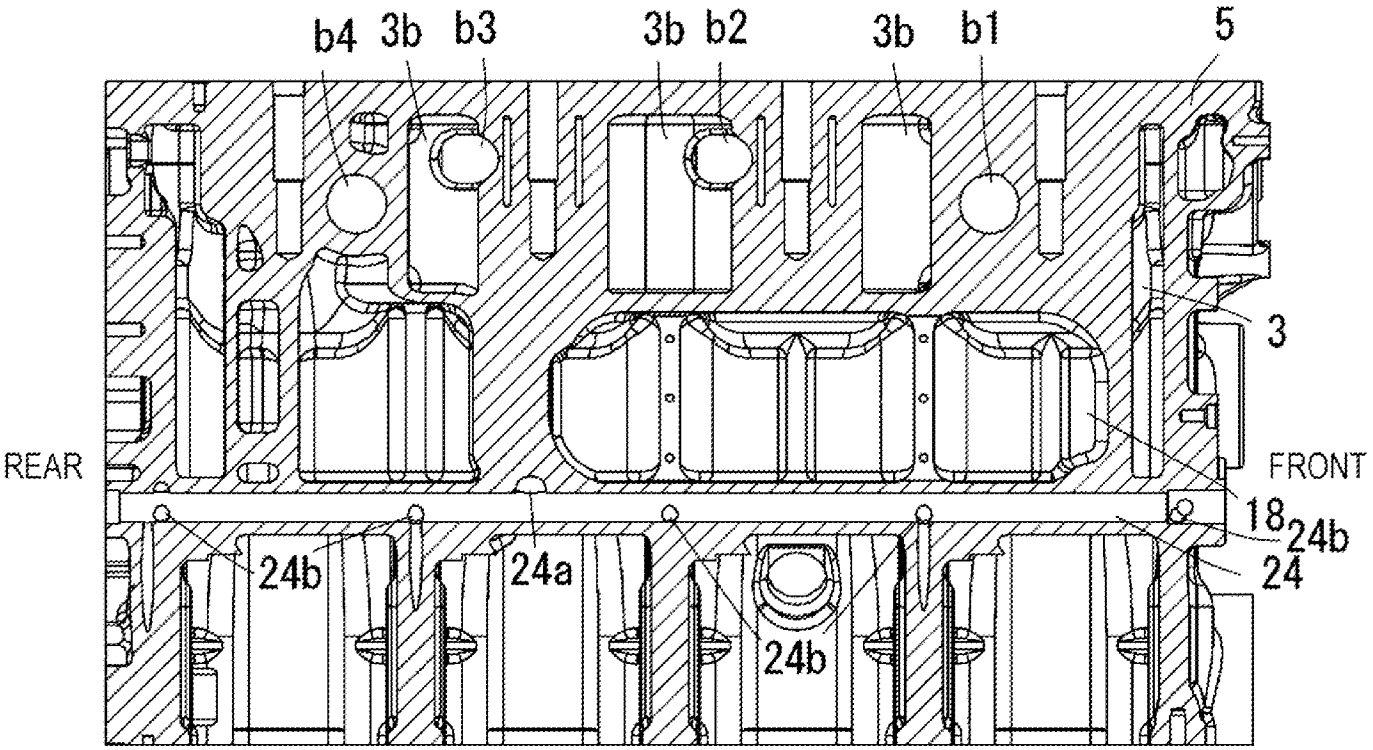
FIG. 3 is a sectional view taken along line in FIG. 1.
Figure 4:
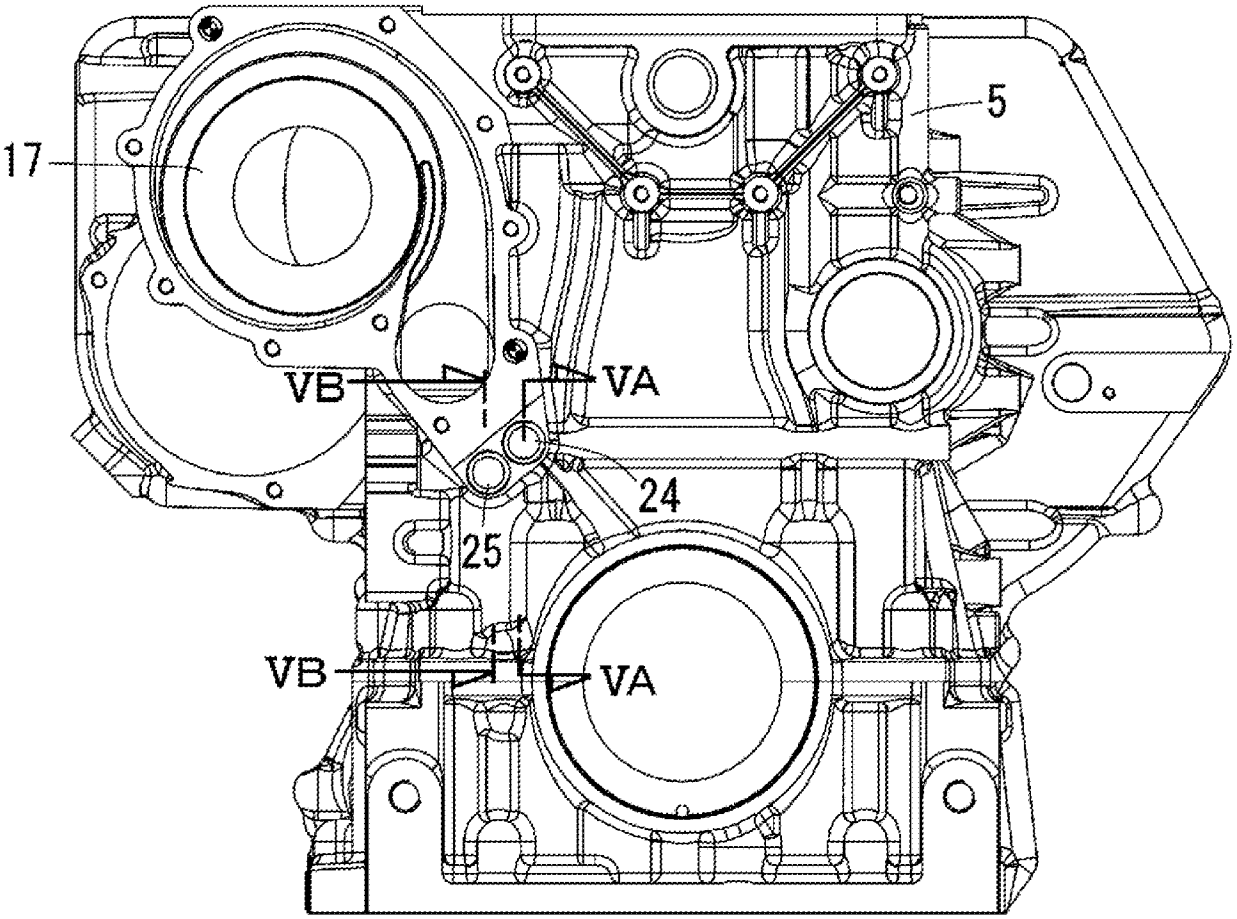
FIG. 4 is a front view of the cylinder block of FIG. 1.

The intermediary water channel (18) shown in FIGS. 3 and 6 is provided between the radiator and the jacket inlet (3*a*).

It is configured such that an entire amount of the engine cooling water (2) from the radiator is supplied to the jacket inlet (3*a*) via the intermediary water channel (18).

Therefore, according to this embodiment, cooling efficiency of the cylinder barrels is increased by a large amount of the engine cooling water (2) supplied from the radiator.

As illustrated in FIG. 6, the oil cooler (21) is provided within the intermediary water channel (18). Therefore, cooling is carried out by the engine cooling water (2) before the engine oil (4*a*) is introduced into the cylinder jacket (3), resulting in high cooling efficiency of the engine oil (4*a*).

As illustrated in FIG. 6, the intermediary water channel (18) is provided by causing a lateral side of the cylinder block (5) to be depressed, the oil cooler (21) is attached to the supplementary-unit attachment base (22), and the oil cooler (21) is inserted into the intermediary water channel (18) covered by the supplementary-unit attachment base (22).

Therefore, according to this embodiment, the oil cooler (21) is inserted into the intermediary water channel (18) depressed by the cylinder block (5), and positioning of the oil cooler (21) may not increase a width of the engine to a large extent.

As illustrated in FIG. 6, the oil filter (23) communicated with the oil cooler (21) is attached to the supplementary-unit attachment base (22).

Therefore, by covering the intermediary water channel (18) with the supplementary-unit attachment base (22) to which the oil cooler (21) and the oil filter (23) are attached, the oil cooler (21) and the oil filter (23) are attached to the cylinder block (5), and thus attachment of the oil cooler (21) and the oil filter (23) is facilitated.

Figure 5A:
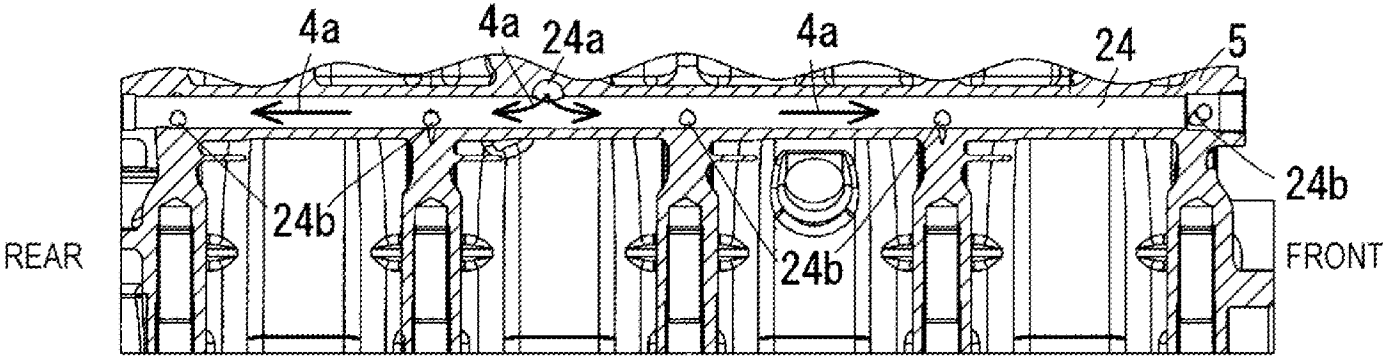
FIG. 5A is a sectional view taken along line VA-VA in FIG. 4.
Figure 5B:
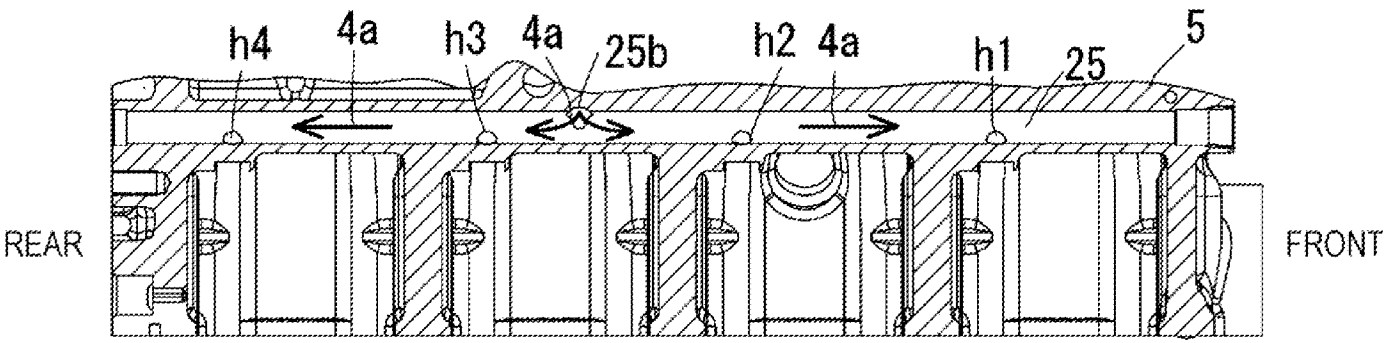
FIG. 5B is a sectional view taken along line VB-VB in FIG. 4.

As illustrated in FIG. 1, the oil gallery (24) includes an oil inlet (24*a*), and oil outlets (24*b*) to journal bearings (8*c*) of the crankshaft (8) illustrated in FIG. 7, and the oil outlets (24*b*) are respectively disposed at positions corresponding to the journal bearings (8*c*) as illustrated in FIG. 5A.

What is claimed is:

1. A vertical multicylinder straight engine, comprising:

a cylinder block around a plurality of cylinder barrels, the cylinder block allowing engine cooling water to pass through a cylinder jacket, wherein the plurality of cylinder barrels include a front-end barrel, a rear-end barrel, and middle barrels disposed between these two barrels, taking a direction along which a crankshaft central axis line extends as a front-rear direction, and a side of a flywheel as a rear side, the cylinder jacket includes: a jacket inlet for introducing the engine cooling water supplied from a radiator; separated channels for diverting the engine cooling water introduced through the jacket inlet in the front-rear direction; a plurality of separated outlets for diverting the engine cooling water diverted in the front-rear direction toward the respective cylinder barrels; and heat dissipater channels for dissipating heat of the respective cylinder barrels to the engine cooling water introduced through the separated outlets, the plurality of separated outlets include: a front-side separated outlet to the front-end barrel; a rear-side separated outlet to the rear-end barrel; and middle separated outlets to the middle barrels between the front-end barrel and the rear-end barrel, and the jacket inlet is disposed so as to be contained within an entire middle barrel side area that is lateral to the middle barrels and has a front-rear length as long as a length from a front-most end to a rear-most end of the middle barrels.

2. The vertical multicylinder straight engine according to claim 1, wherein the front-side separated outlet is disposed so as to be contained within a front-end barrel side area that is lateral to the front-end barrel and has a front-rear length as long as a length of the front-end barrel, the rear-side separated outlet is disposed so as to be contained within a rear-end barrel side area that is lateral to the rear-end barrel and has a front-rear length as long as a length of the rear-end barrel, and the middle separated outlets are disposed so as to be respectively contained within middle barrel side areas that are lateral to the middle barrels and have front-rear lengths as long as lengths of the middle barrels.

3. The vertical multicylinder straight engine according to claim 2, wherein the engine is a four-cylinder engine, and the jacket inlet is disposed on a backward side of the entire middle barrel side area, the front-side separated outlet is disposed on a backward side of the front-end barrel side area, the rear-side separated outlet is disposed on a forward side of the rear-end barrel side area, and a pair of the middle separated outlets are respectively disposed on a backward side of a pair of the middle barrel side areas.

4. The vertical multicylinder straight engine according to claim 3, wherein the cylinder jacket includes a series of partition walls that divide the separated channels from the heat dissipater channels, and the partition walls are bended along concavity and convexity of side-projecting curved sections of a pair of the middle barrels and a side-depression section between the side-projecting curved sections, and the partition walls include screw bosses at both ends and at bended portions, the screw bosses being for screw fitting with head bolts for fastening a cylinder head to the cylinder block.

5. The vertical multicylinder straight engine according to claim 4, wherein the cylinder jacket includes a transverse channel, between the cylinder barrels that are adjacent to each other, through which the engine cooling water passes, and the screw bosses are raised from the partition walls toward a channel inlet of the transverse channel.

6. The vertical multicylinder straight engine according to claim 4, wherein the screw bosses are raised from the partition walls toward the side-projecting curved sections of the middle barrels.

7. The vertical multicylinder straight engine according to claim 2, wherein the cylinder jacket includes a series of partition walls that divide the separated channels from the heat dissipater channels, and the partition walls are bended along concavity and convexity of side-projecting curved sections of a pair of the middle barrels and a side-depression section between the side-projecting curved sections, and the partition walls include screw bosses at both ends and at bended portions, the screw bosses being for screw fitting with head bolts for fastening a cylinder head to the cylinder block.

8. The vertical multicylinder straight engine according to claim 7, wherein the cylinder jacket includes a transverse channel, between the cylinder barrels that are adjacent to each other, through which the engine cooling water passes, and the screw bosses are raised from the partition walls toward a channel inlet of the transverse channel.

9. The vertical multicylinder straight engine according to claim 7, wherein the screw bosses are raised from the partition walls toward the side-projecting curved sections of the middle barrels.

10. The vertical multicylinder straight engine according to claim 1, wherein the cylinder jacket includes a series of partition walls that divide the separated channels from the heat dissipater channels, and the partition walls are bended along concavity and convexity of side-projecting curved sections of a pair of the middle barrels and a side-depression section between the side-projecting curved sections, and the partition walls include screw bosses at both ends and at bended portions, the screw bosses being for screw fitting with head bolts for fastening a cylinder head to the cylinder block.

11. The vertical multicylinder straight engine according to claim 10, wherein the cylinder jacket includes a transverse channel, between the cylinder barrels that are adjacent to each other, through which the engine cooling water passes, and the screw bosses are raised from the partition walls toward a channel inlet of the transverse channel.

12. The vertical multicylinder straight engine according to claim 11, wherein the screw bosses are raised from the partition walls toward the side-projecting curved sections of the middle barrels.

13. The vertical multicylinder straight engine according to claim 10, wherein the screw bosses are raised from the partition walls toward the side-projecting curved sections of the middle barrels.

14. The vertical multicylinder straight engine according to claim 1, wherein an opening lower edge of each of the separated outlets is disposed at a position higher than a vertical center of a cylinder barrel to which the corresponding separated outlet faces.

15. The vertical multicylinder straight engine according to claim 14, wherein the opening lower edge of each of the separated outlets is disposed at a position lower than a lowermost position of a pressure ring of a piston at a top dead point within the cylinder barrel to which the corresponding separated outlet faces, and at a position higher than a lowermost position of the piston.

16. The vertical multicylinder straight engine according to claim 1, wherein the cylinder block includes: an oil inlet for introducing engine oil supplied from an oil pump; oil delivery channels for diverting the engine oil introduced through the oil inlet in the front-rear direction; a plurality of diverting oil outlets for diverting the engine oil that is diverted in the front-rear direction by the oil delivery channels to an oil jet nozzle facing the piston, the oil delivery channels are directed in the front-rear direction, and the plurality of the diverting oil outlets include: a front diverting oil outlet and a rear diverting oil outlet that are respectively disposed on a front side and a rear side of the oil delivery channel; and intermediate diverting oil outlets that are disposed between the front diverting oil outlet and the rear diverting oil outlet, and the oil inlet is disposed at a position overlapping the entire middle barrel side area when viewed parallelly with a cylinder central axis line.

17. The vertical multicylinder straight engine according to claim 1, comprising:

an intermediary water channel between the radiator and the jacket inlet, wherein an entire amount of the engine cooling water from the radiator is supplied to the jacket inlet via the intermediary water channel.

18. The vertical multicylinder straight engine according to claim 17, comprising:

an oil cooler disposed within the intermediary water channel.

19. The vertical multicylinder straight engine according to claim 18, wherein the intermediary water channel is provided by causing a lateral side of the cylinder block to be depressed, the oil cooler is attached to a supplementary-unit attachment base, and the oil cooler is inserted into the intermediary water channel covered by the supplementary-unit attachment base.

20. The vertical multicylinder straight engine according to claim 19, wherein an oil filter communicated with the oil cooler is attached to the supplementary-unit attachment base.

* * * * *